United States Patent [19]

Kamezaki et al.

[11] 4,003,355

[45] Jan. 18, 1977

[54] CARBURETOR CHOKE VALVE CONTROL DEVICE

[75] Inventors: Takashi Kamezaki; Masahiko Iiyama, both of Tokyo, Japan

[73] Assignee: Honda Giken Kogyo Kabushiki Kaisha, Tokyo, Japan

[22] Filed: July 3, 1975

[21] Appl. No.: 593,009

[30] Foreign Application Priority Data

July 5, 1974 Japan ..... 49-76484

[52] U.S. Cl. ..... 123/119 F; 261/23 A; 261/39 A; 261/39 B; 123/127

[51] Int. Cl.[2] ..... F02M 1/10

[58] Field of Search ..... 123/119 F, 127; 261/23 A, 39 A, 39 B

[56] References Cited

UNITED STATES PATENTS

| | | | |
|---|---|---|---|
| 2,810,559 | 10/1957 | Winkler | 261/39 A |
| 2,946,577 | 7/1960 | Dennison et al. | 123/119 F |
| 2,957,465 | 10/1960 | Wagner | 123/119 F |
| 3,109,874 | 11/1963 | Mennesson | 123/119 F |
| 3,205,879 | 9/1965 | Von Seggern et al. | 123/127 |
| 3,263,973 | 8/1966 | Purcell | 261/39 B |
| 3,291,462 | 12/1966 | Mennesson | 261/39 A |
| 3,544,085 | 12/1970 | Bier | 261/39 B |
| 3,837,322 | 9/1974 | Shishido et al. | 123/119 F |

*Primary Examiner*—Wendell E. Burns
*Assistant Examiner*—David D. Reynolds
*Attorney, Agent, or Firm*—Lyon & Lyon

[57] ABSTRACT

A dual carburetor system employs a main carburetor to supply a lean mixture to the main combustion chambers of an engine and an auxiliary carburetor to supply a rich mixture to the auxiliary combustion chambers of the engine. Each carburetor has a choke valve operated by a thermo-responsive device. Each carburetor has a locking lever which cooperates with an element connected to its choke valve to lock the choke valve in open position. A device responsive to temperature of the engine coolant operates a single member which moves both locking levers to locking position upon increase in temperature of the engine coolant.

6 Claims, 2 Drawing Figures

CARBURETOR CHOKE VALVE CONTROL DEVICE

This invention relates to choke valve devices employed in carburetors for internal combustion engines. In such devices, a thermo-responsive device containing an electric heater or other suitable device acts to open each choke valve as the engine operation continues. In such a system, the heating means for the thermo-responsive device is caused to be de-energized immediately upon stopping of the engine. However, should a fully warmed-up engine be stopped and then restarted while still warm, the thermo-responsive device radiates heat to close the choke valve before the engine temperature lowers and, consequently, excessively rich mixture is produced by the carburetor, thereby lowering startability of the engine. Furthermore, even when the warm engine is restarted, harmful unburned components in the exhaust gas increase in concentration.

In order to eliminate such ill effects, this invention aims at providing a choke valve control system which is capable, even when the engine is at rest and is still warm, of sensing the engine temperature to hold each choke valve at its approximately fully opened position. The invention also assures that, upon restarting of the warm engine, no hindrance can occur to automatic control of the choke valve opening, even if the apparatus should malfunction.

This invention will be described in connection with a carburetor assembly for an internal combustion engine in which each main combustion chamber is provided with an auxiliary combustion chamber, one carburetor producing a lean mixture to supply the main combustion chambers, and the other carburetor producing a rich mixture to supply the auxiliary combustion chambers.

Other and more detailed objects and advantages will appear hereinafter.

Figure 1:
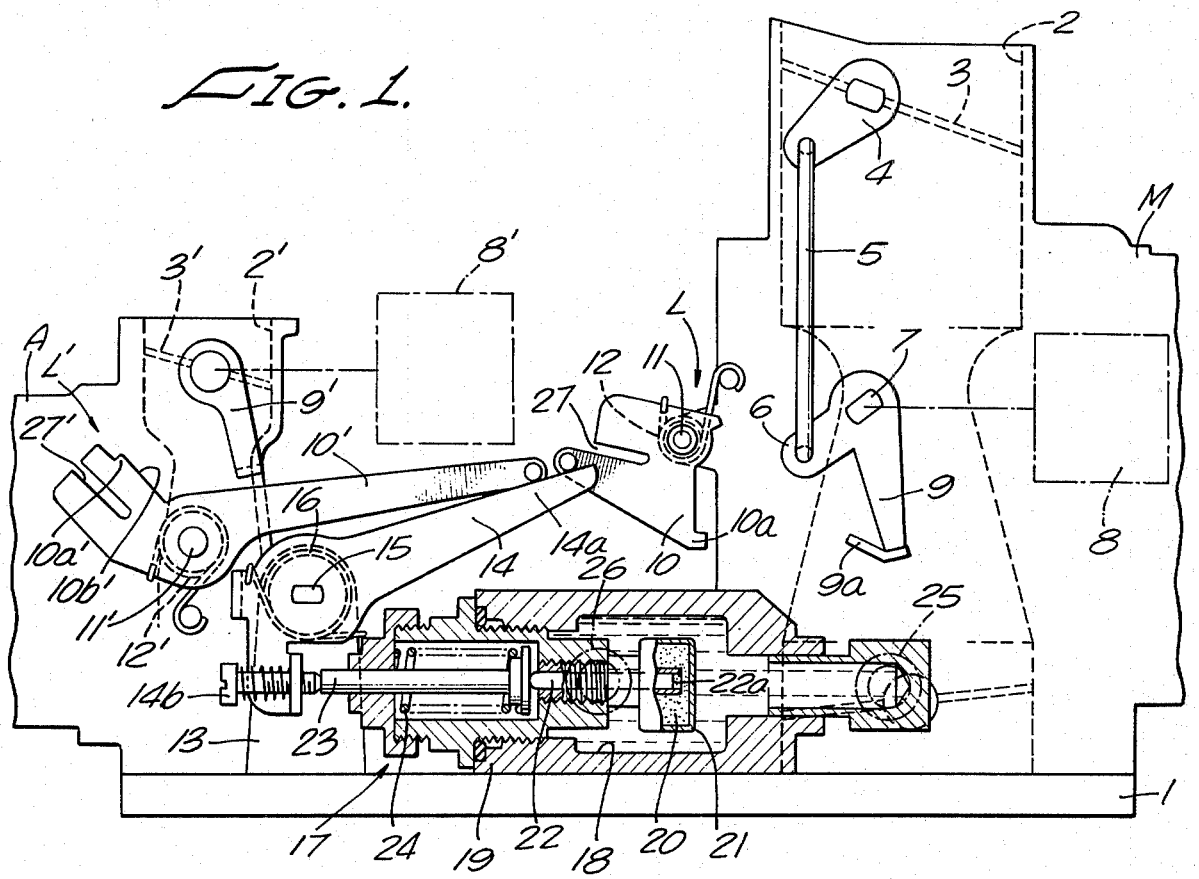
FIG. 1 is a side elevation partly in section showing a preferred embodiment of this invention. The parts are in the position corresponding to a cold engine at rest.

Referring to the drawings, the carburetor assembly shown is intended for use with an internal combustion engine in which each cylinder is provided with a main combustion chamber and an auxiliary combustion chamber. A main carburetor M is connected to the main combustion chamber and an auxiliary carburetor A is connected to the auxiliary combustion chamber, both carburetors being mounted on the base plate 1 connected to the intake manifold on the engine, not shown.

Both carburetors M and A are provided with choke valves 3 and 3′ and upstream intake passages 2 and 2′, respectively, the choke valve 3 being connected through choke lever 4 and connecting rod 5 with a control lever 6. A rotary shaft 7 fixed to the control lever 6 is connected to a conventional thermo-responsive device 8 for choke valve control. This device 8 may contain thermal deformation materials such as a bimetal, and is heated by an electric heater or any other suitable heating means when the engine is in operation. Heating of the thermo-responsive device 8 serves to turn the control lever 6 in a direction to open the choke valve 3. A similar thermo-responsive device 8′ is connected to turn the choke valve 3′ in the auxiliary carburetor A. The control lever 6 is provided with an arm 9 which has on its distal end a slanting slipper 9*a*. A locking lever 10 is provided with a shoulder 10*a* which may be engaged by the distal end of the arm 9. This locking lever 10 is pivotally mounted at 11 on the outside of the main carburetor M. A relatively weak torsion spring 12 acts to move the locking lever 10 in a counterclockwise direction, as shown in the drawings, to bring the shoulder 10*a* into the path of the distal end of the arm 9.

Similarly, an arm 9′ fixed with respect to the auxiliary choke valve 3′ has a distal end adapted to engage the shoulder 10*a*′ on the locking lever 10′ which is pivotally mounted on the outside of the carburetor A at 11′. A relatively weak torsion spring 12′ acts on the locking lever 10′ to move it in a clockwise direction to bring the shoulder 10*a* into the path of movement of the arm 9′. A slipper surface 10*b*′ is provided on the locking lever 10′ and this slipper surface extends to the position of the shoulder 10*a*′.

The locking levers 10 and 10′ and the arms 9 and 9′, together with the torsion springs 12 and 12′, constitute one-way locking mechanisms L and L′, respectively, which restrict closing movement of the choke valves 3 and 3′ from their approximately fully opened position, while permitting reverse movement of the choke valves 3 and 3′ toward open position.

A bracket 13 fixed to the base plate 1 pivotally supports a bell crank 14 at 15. One end 14*a* of the bell crank 14 engages a portion of each locking lever 10 and 10′ and is provided with a relatively strong torsion spring 16 which acts to turn the bell crank 14 against the force of the torsion springs 12 and 12′ in a counterclockwise direction, as viewed in the drawings. The other end of the bell crank 14 is provided with an adjusting screw 14*b* which engages the output rod 23 of the thermo-responsive device 17. This device 17 has a stationary case 19 containing a heating chamber 18 connected to the coolant system of the engine through the inlet 26 and the outlet 25. An air-tight stationary cylinder 21 is housed in the heating chamber 18 and contains thermal expansion material 20 such as wax. A plunger 22 is supported within the case 19 in a manner to slide freely, and the inner end 22*a* of this plunger is exposed to the thermal expansion material 20 within the cylinder 21. The output rod 23 is axially aligned with and contacts the projecting end of the plunger 22. This output rod is also mounted to slide freely on the case 19. A return spring 24 acts on the output rod 23 in a direction to urge the plunger 22 to move back into the cylinder 21.

The slit 27 in the locking lever 10 and the slit 27′ in the locking lever 10′ are provided for positional adjustment; they may be expanded or contracted for proper positioning of the shoulders 10*a* and 10*a*′, respectively.

From the foregoing description it will be understood that, when the engine temperature is low, the engine coolant reflecting this low temperature keeps the chamber 18 at a relatively low temperature, so that the thermal expansion material 20 contracts. The plunger 22 and the output rod 23 are therefore held in retracted position by the force of the return spring 24. The bell crank 14 is held in the position shown in FIG. 1 by the torsion spring 16. Both locking levers 10 and 10′ are engaged by an end portion 14*a* of the bell crank 14 and it holds them in the inoperative position shown in FIG. 1. In this position they are out of the arcuate paths of the arms 9 and 9', respectively. In other words, both one-way locking mechanisms L and L' are placed in the nonfunctioning position.

When the cold engine is started, electrical energy supplied to conventional electric heaters causes the thermo-responsive devices 8 and 8' to open the choke valves 3 and 3'. As the engine temperature rises, vaporization of fuel in the mixtures produced by the carburetors M and A is improved.

When the engine temperature has risen sufficiently and the engine coolant within the heating chamber 18 has reached a sufficiently high temperature, the thermal expansion material 20 moves the plunger 22 to the left, as viewed in the drawings, thereby projecting the output rod 23 against the action of the return spring 24, and causing the bell crank 14 to move in a clockwise direction against the torsion spring 16. This permits both locking levers 10 and 10' to turn to their respective locking positions, with the shoulders 10*a* and 10*a*' thereof engaging the respective ends of the arms 9 and 9' that have been placed in the locking position by the action of the thermo-responsive devices 8 and 8'.

Figure 2:
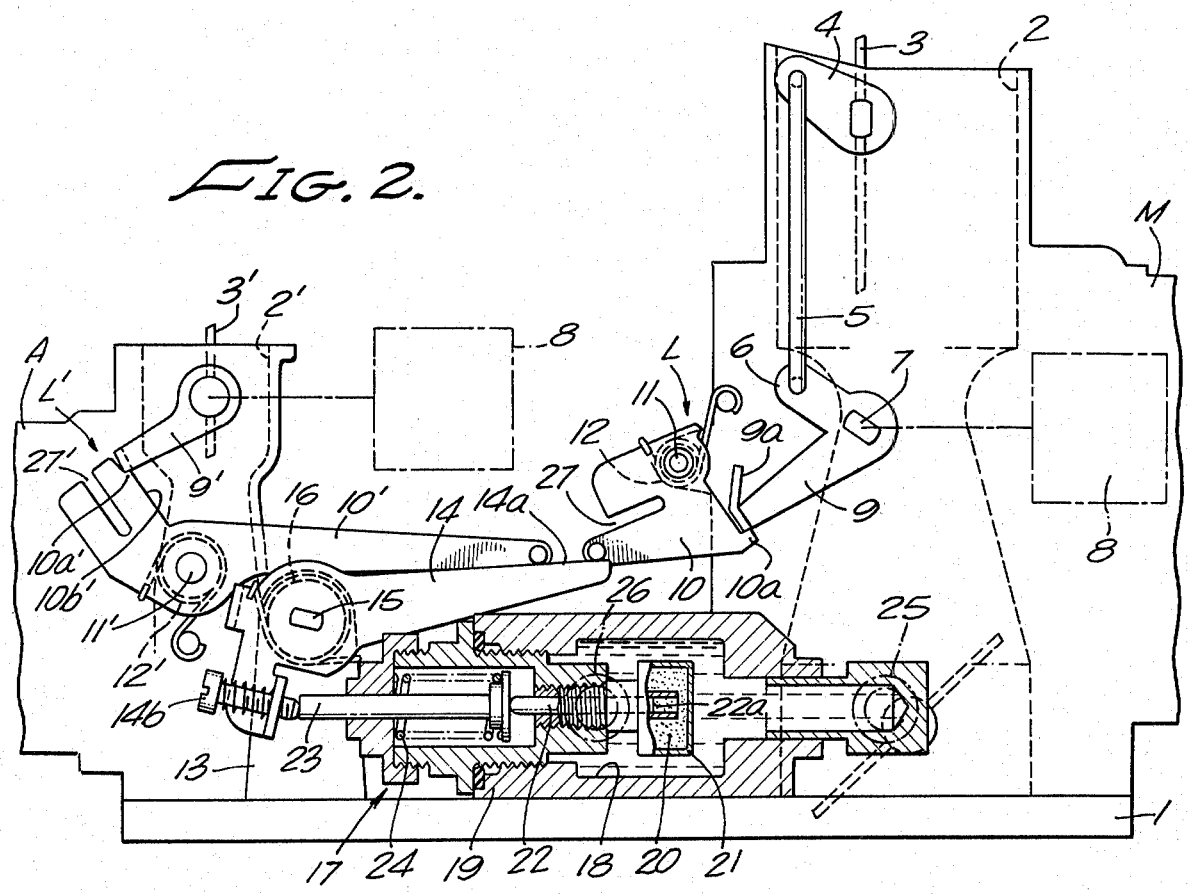
FIG. 2 is a view similar to FIG. 1 showing the position of the parts when the engine is at rest but is still hot from previous operation.

If the engine should come to a stop at this moment, the choke valves 3 and 3' are prevented from closing and are maintained at their fully open position, even though the thermo-responsive devices 8 and 8' begin to cool off and exert forces which, in the absence of the locking devices L and L', would return the choke valves 3 and 3' toward closed position. As long as the engine coolant in the chamber 18 remains at a relatively high temperature, the parts remain in the position shown in FIG. 2, and thus restarting of the engine while it is still hot is accomplished with the choke valves 3 and 3' in the open position. In this way, the mixtures provided by the carburetors M and A do not become excessively rich.

If the engine should come to a stop before it is fully warmed up, and hence before the arms 9 and 9' reach the locking position, the temperature of the engine coolant rises for a short time by reason of ambient heat, and the thermal expansion material 20 expands, thereby causing the bell crank 14 to permit the locking levers 10 and 10' to move to their respective locking positions. This may occur while the arms 9 and 9' are still in an intermediate position between that shown in FIG. 1 and that shown in FIG. 2. With the arms 9 and 9' in such an intermediate position, the starting of the engine causes the thermo-responsive devices 8 and 8' to move the arms 9 and 9' in a direction to open the choke valves 3 and 3', respectively. In this situation, the slanted slipper 9*a* on the arm 9 and the slipper surface 10*b*' on the locking lever 10' permit the arms 9 and 9' to move into locking engagement with the shoulders 10*a* and 10*a*', respectively. The parts thus reach the locked position shown in FIG. 2.

As described above, when the warm engine is at rest, the choke valves 3 and 3' that have already been substantially fully opened can be maintained in that position by the one-way locking mechanisms L and L'. Thus, when restarting the warm engine, the air-fuel mixtures maintain the proper air-fuel ratio for improved startability. Also, the one-way locking mechanisms L and L' do not restrict valve opening movement of the choke valves 3 and 3' so that, even if the mechanisms should malfunction, valve opening control of the choke valves 3 and 3' can be properly accomplished.

Having fully described our invention, it is to be understood that we are not to be limited to the details herein set forth, but that our invention is of the full scope of the appended claims.

We claim:

1. For use with an internal combustion piston engine in which each cylinder is provided with a combustion chamber, a choke valve assembly comprising, in combination: a carburetor for supplying an air-fuel mixture to the combustion chambers, said carburetor having a choke valve and an arm connected to operate the choke valve, a thermo-responsive device for operating said choke valve, a locking element having a shoulder, said shoulder adapted to engage the arm to lock said choke valve in open position, a relatively weak spring acting to move said locking element toward an operative position in which said shoulder engages said arm, a bell crank having a first end operatively connected to the locking element and a second end, a relatively strong spring acting on said bell crank to move said locking element against said weak spring to an inoperative position in which said locking element disengages said arm, an engine temperature responsive device operatively connected to the second end of said bell crank, so that when engine temperature is high said device turns said bell crank against said relatively strong spring whereby said shoulder is moved to the operative position.

2. The combination set forth in claim 1 in which said temperature responsive device includes a case having a chamber therein through which engine coolant may circulate, a thermal expansion device having at least a portion thereof disposed within said chamber, said thermal expansion device including an axially movable plunger engaging the second end of said bell crank.

3. The combination set forth in claim 1 in which a slipper is provided on said arm to permit it to move into locking engagement with said shoulder after the locking element has been moved to the operative position.

4. For use with an internal combustion piston engine in which each cylinder is provided with a main combustion chamber and an auxiliary combustion chamber communicating therewith, a carburetor choke valve assembly comprising, in combination: a first carburetor for supplying a lean mixture to the main combustion chambers, a second carburetor for supplying a rich mixture to the auxiliary combustion chambers, each carburetor having a choke valve and an arm connected to turn with the choke valve, each carburetor having a thermo-responsive device for operating its choke valve, each carburetor also having a locking element provided with a shoulder, each shoulder being adapted to engage its respective arm to lock said choke valve in open position, a relatively weak spring acting to move said each locking element toward an operative position in which said shoulders engage said arms, respectively, a bell crank having a first end operatively connected to the locking elements and a second end, a relatively strong spring acting on said bell crank to move said locking elements against said weak springs to inoperative positions in which said locking elements disengage said arms, an engine temperature responsive device operatively connected to the second end of said bell crank, so that when engine temperature is high said device turns said bell crank against said relatively strong spring whereby said shoulders move to their operative positions.

5. The combination set forth in claim 4 in which said temperature responsive device includes a case having a chamber therein through which engine coolant may circulate, a thermal expansion device having at least a portion thereof disposed within said chamber, said thermal expansion device including an axially movable plunger engaging the second end of said bell crank.

6. The combination set forth in claim 4 in which slipper means are provided on each arm to permit said arms to move into locking engagement with said shoulders after the locking elements have been moved to the operative position.

* * * * *